US012663193B2

(12) United States Patent
Bolek et al.

(10) Patent No.: US 12,663,193 B2
(45) Date of Patent: Jun. 23, 2026

(54) ICE MAKING ASSEMBLY FOR A REFRIGERATOR APPLIANCE

(71) Applicant: Haier US Appliance Solutions, Inc., Wilmington, DE (US)

(72) Inventors: Slawomir Pawel Bolek, Goshen, KY (US); Charles Benjamin Miller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 63 days.

(21) Appl. No.: 18/738,894

(22) Filed: Jun. 10, 2024

(65) Prior Publication Data

US 2025/0377145 A1 Dec. 11, 2025

(51) Int. Cl.

| | |
|---|---|
| ***F25C 1/18*** | (2006.01) |
| ***F25C 1/10*** | (2006.01) |
| ***F25C 1/25*** | (2018.01) |

(52) U.S. Cl.

CPC ..... *F25C 1/18* (2013.01); *F25C 1/10* (2013.01); *F25C 1/25* (2018.01); *F25C 2400/10* (2013.01); *F25C 2600/04* (2013.01); *F25C 2700/12* (2013.01)

(58) Field of Classification Search

CPC ..... F25C 1/18; F25C 1/10; F25C 1/25; F25C 2400/10; F25C 2600/04; F25C 2700/12; F25C 5/22; F25C 5/08

See application file for complete search history.

(56) References Cited

U.S. PATENT DOCUMENTS

| | | | | |
|---|---|---|---|---|
| 3,864,933 | A * | 2/1975 | Bright | F25C 1/04 62/137 |
| 6,157,777 | A | 12/2000 | Banks et al. | |
| 9,719,711 | B2 | 8/2017 | Bortoletto et al. | |
| 10,670,317 | B2 | 6/2020 | Wu et al. | |
| 2015/0362243 | A1* | 12/2015 | Ko et al. | F25C 1/10 62/346 |
| 2017/0299244 | A1* | 10/2017 | Pohl et al. | F25C 5/06 |

(Continued)

FOREIGN PATENT DOCUMENTS

| | | | |
|---|---|---|---|
| KR | 20060007510 | A | 1/2006 |
| KR | 100827785 | B1 | 5/2008 |

(Continued)

*Primary Examiner* — Jerry-Daryl Fletcher
*Assistant Examiner* — Dario Antonio Deleon
(74) *Attorney, Agent, or Firm* — Dority & Manning, P.A.

(57) ABSTRACT

A refrigerator appliance includes a cabinet defining a chilled chamber, a door rotatably mounted to the cabinet and rotatable between a closed position enclosing the chilled chamber and an open position providing access to the chilled chamber, and an ice making assembly mounted to the door of the refrigerator appliance. The ice making assembly includes an icemaker frame assembly mounted to the door and defining an ice making chamber, an ice tray mounted to the icemaker frame assembly and defining a plurality of mold cavities for receiving water that is formed into ice, a fill tube for selectively supplying the water into the ice tray, and a heating assembly comprising a heating element and a heat sink that are thermally coupled to the fill tube, wherein the heating element is selectively energized to heat the water flowing through the fill tube and the ice making chamber.

18 Claims, 5 Drawing Sheets

(56) References Cited

U.S. PATENT DOCUMENTS

| | | | | |
|---|---|---|---|---|
| 2017/0307275 | A1* | 10/2017 | French et al. | F25C 5/08 |
| 2018/0017313 | A1* | 1/2018 | Park et al. | F25D 23/003 |
| 2021/0041154 | A1* | 2/2021 | Mitchell | F25C 5/22 |
| 2022/0170680 | A1* | 6/2022 | Junge et al. | F25C 1/24 |
| 2022/0349642 | A1* | 11/2022 | Yan et al. | F25C 5/04 |
| 2025/0283639 | A1* | 9/2025 | Kang et al. | F25D 11/025 |

FOREIGN PATENT DOCUMENTS

| | | | |
|---|---|---|---|
| KR | 101457691 | B1 | 11/2014 |
| WO | WO2003058139 | A1 | 7/2003 |
| WO | WO2012136557 | A2 | 12/2012 |

* cited by examiner

ICE MAKING ASSEMBLY FOR A REFRIGERATOR APPLIANCE

FIELD OF THE INVENTION

The present subject matter relates generally to refrigerator appliances, and more particularly to ice making assemblies for a refrigerator appliance.

BACKGROUND OF THE INVENTION

Refrigerator appliances generally include a cabinet that defines one or more chilled chambers for receipt of food articles for storage. Typically, one or more doors are rotatably hinged to the cabinet to permit selective access to food items stored in the chilled chamber. Further, refrigerator appliances commonly include ice making assemblies mounted within an icebox on one of the doors or in a freezer compartment. The ice is stored in a storage bin and is accessible from within the freezer chamber or may be discharged through a dispenser recess defined on a front of the refrigerator door.

Certain conventional refrigerator appliances have icemakers that are designed to form clear ice, e.g., such as large craft ice cubes with improved clarity. Making clear ice often requires that the ice makers slow the freezing rate by insulating the icemaker to help maintain slightly higher localized temperatures in the icemaker enclosure. Additional heaters may be used to help control localized temperature inside of an insulated enclosure. However, these chamber heaters are additional parts added to the system that require an extra electrical connection, driving up the cost and complexity of system.

Accordingly, a refrigerator appliance with features for improved ice making would be desirable. More particularly, an ice making assembly that facilitates improved ice making temperature for forming clear ice with minimal cost and complexity would be particularly beneficial.

BRIEF DESCRIPTION OF THE INVENTION

Aspects and advantages of the invention will be set forth in part in the following description, may be apparent from the description, or may be learned through practice of the invention.

In one exemplary embodiment, a refrigerator appliance defining a vertical direction, a lateral direction, and a transverse direction is provided, including a cabinet defining a chilled chamber, a door rotatably mounted to the cabinet and rotatable between a closed position enclosing the chilled chamber and an open position providing access to the chilled chamber, and an ice making assembly of the refrigerator appliance. The ice making assembly includes an icemaker frame assembly defining an ice making chamber, an ice tray mounted to the icemaker frame assembly and defining a plurality of mold cavities for receiving water that is formed into ice, a fill tube for selectively supplying the water into the ice tray, and a heating assembly comprising a heating element and a heat sink that are thermally coupled to the fill tube, wherein the heating element is selectively energized to heat the water flowing through the fill tube and the ice making chamber.

In another exemplary embodiment, an ice making assembly of a refrigerator appliance is provided. The ice making assembly includes an icemaker frame assembly defining an ice making chamber, an ice tray mounted to the icemaker frame assembly and defining a plurality of mold cavities for receiving water that is formed into ice, a fill tube for selectively supplying the water into the ice tray, and a heating assembly comprising a heating element and a heat sink that are thermally coupled to the fill tube, wherein the heating element is selectively energized to heat the water flowing through the fill tube and the ice making chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
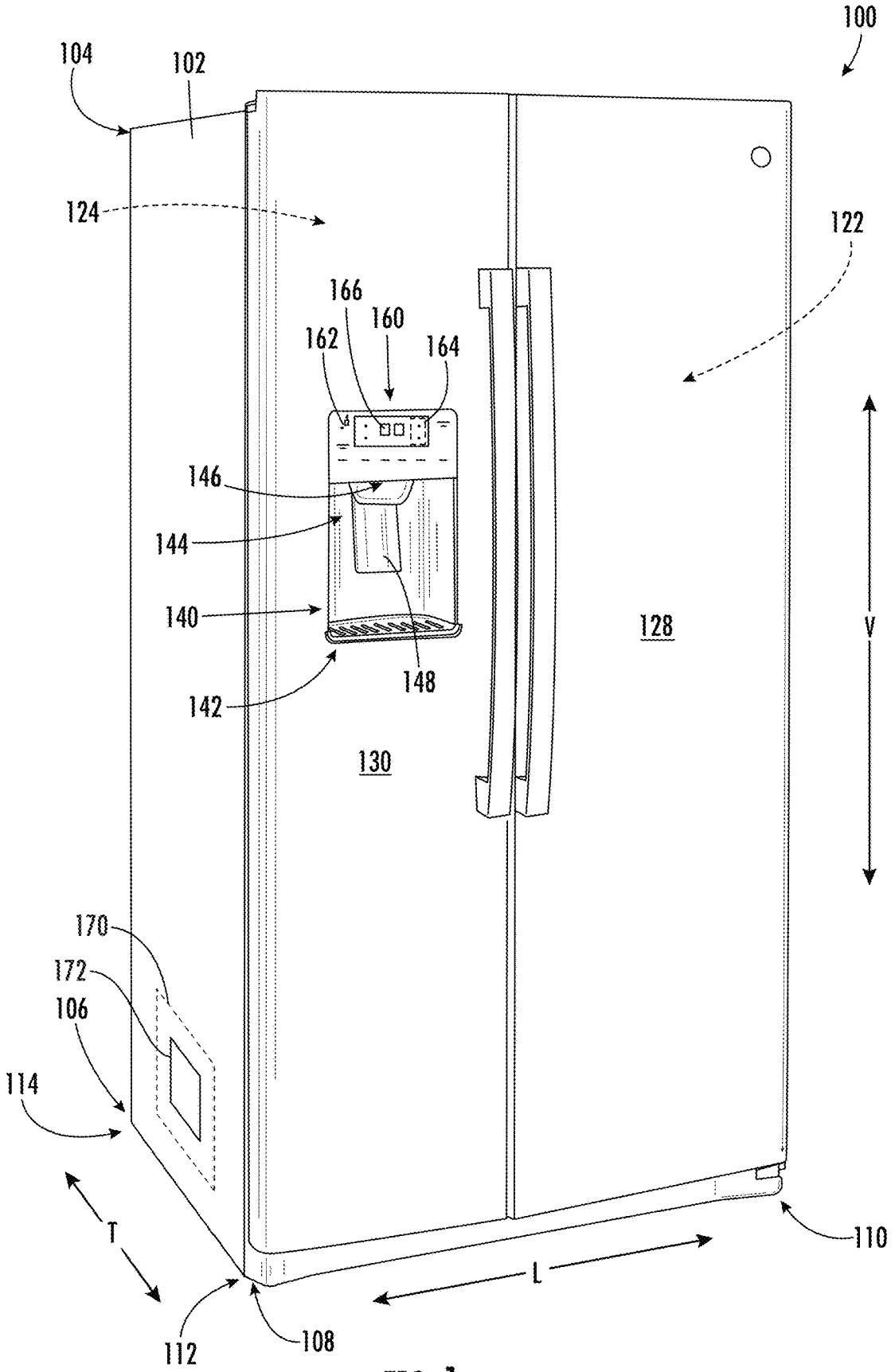
FIG. 1 provides a perspective view of a refrigerator appliance according to an example embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). The term "at least one of" in the context of, e.g., "at least one of A, B, and C" refers to only A, only B, only C, or any combination of A, B, and C. In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent second side 110 of housing 102 and a freezer chamber 124 arranged at or adjacent first side 108 of housing 102. As such, refrigerator appliance 100 is generally referred to as a side-by-side refrigerator. It is recognized, however, that the benefits of the present disclosure apply to other types and styles of refrigerator appliances such as, e.g., a top mount refrigerator appliance, a bottom mount refrigerator appliance, or a single door refrigerator appliance. Consequently, the description set forth herein is for illustrative purposes only and is not intended to be limiting in any aspect to any particular refrigerator chamber configuration.

A refrigerator door 128 is rotatably hinged to an edge of housing 102 for selectively accessing fresh food chamber 122. In addition, a freezer door 130 is rotatably hinged to an edge of housing 102 for selectively accessing freezer chamber 124. Refrigerator door 128 and freezer door 130 are shown in the closed configuration in FIG. 1. One skilled in the art will appreciate that other chamber and door configurations are possible and within the scope of the present invention.

Figure 2:
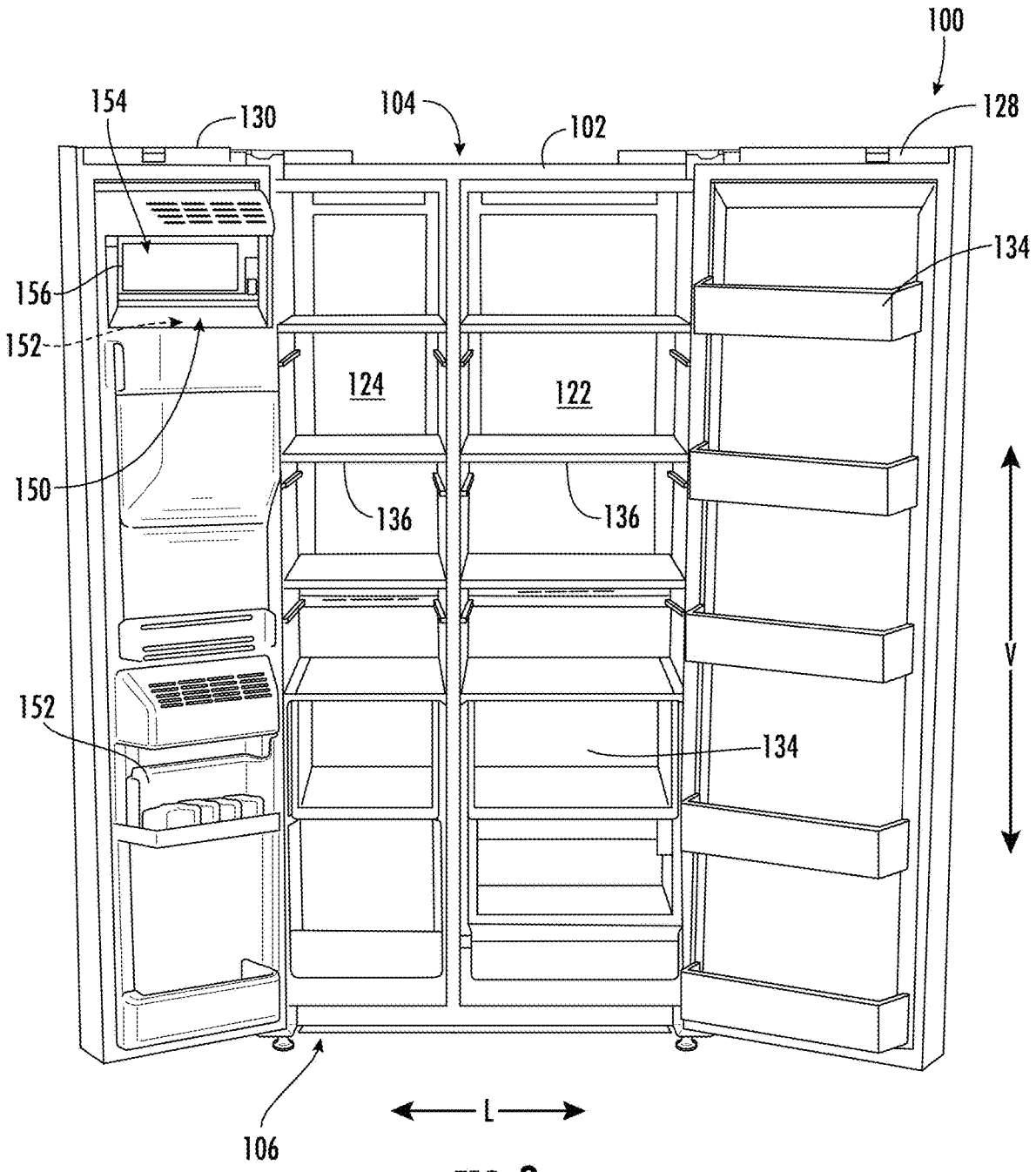
FIG. 2 provides a front view of the example refrigerator appliance of FIG. 1, with the doors of the fresh food chamber and freezer chamber shown in an open position.
Figure 3:
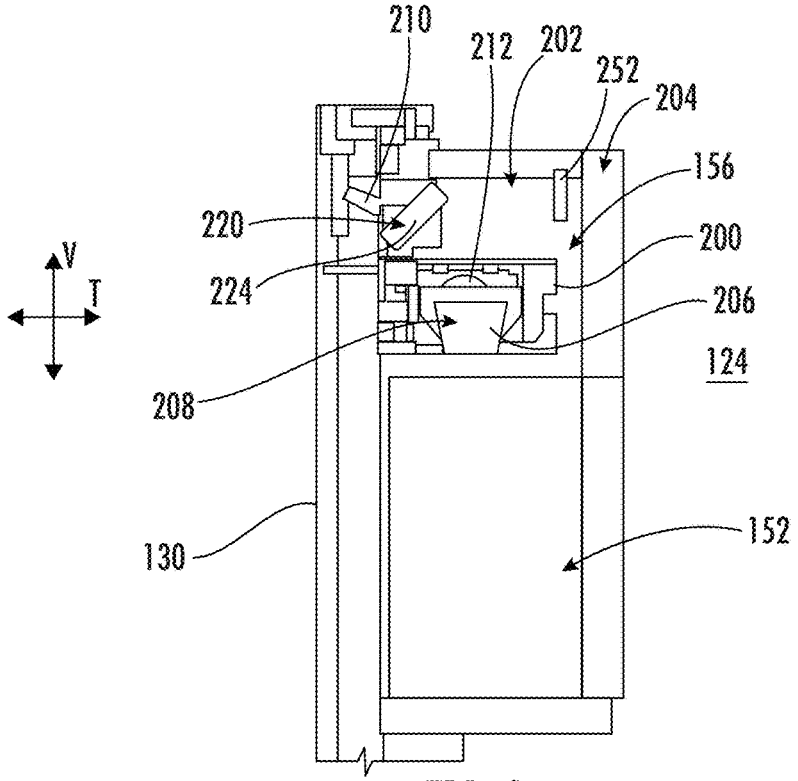
FIG. 3 provides a cross-sectional view of an ice making assembly for use with the example refrigerator appliance of FIG. 1 according to an example embodiment of the present subject matter.
Figure 4:
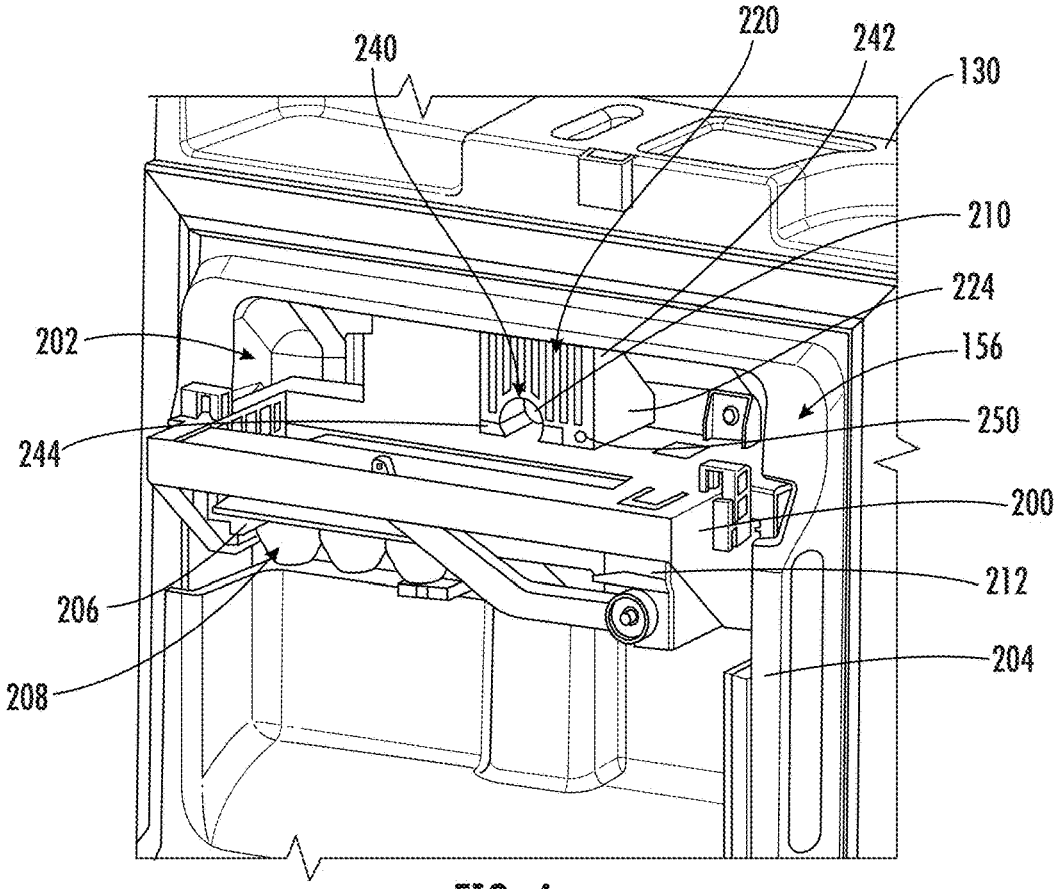
FIG. 4 provides a perspective view of the example ice making assembly of FIG. 3 according to an example embodiment of the present subject matter.
Figure 5:
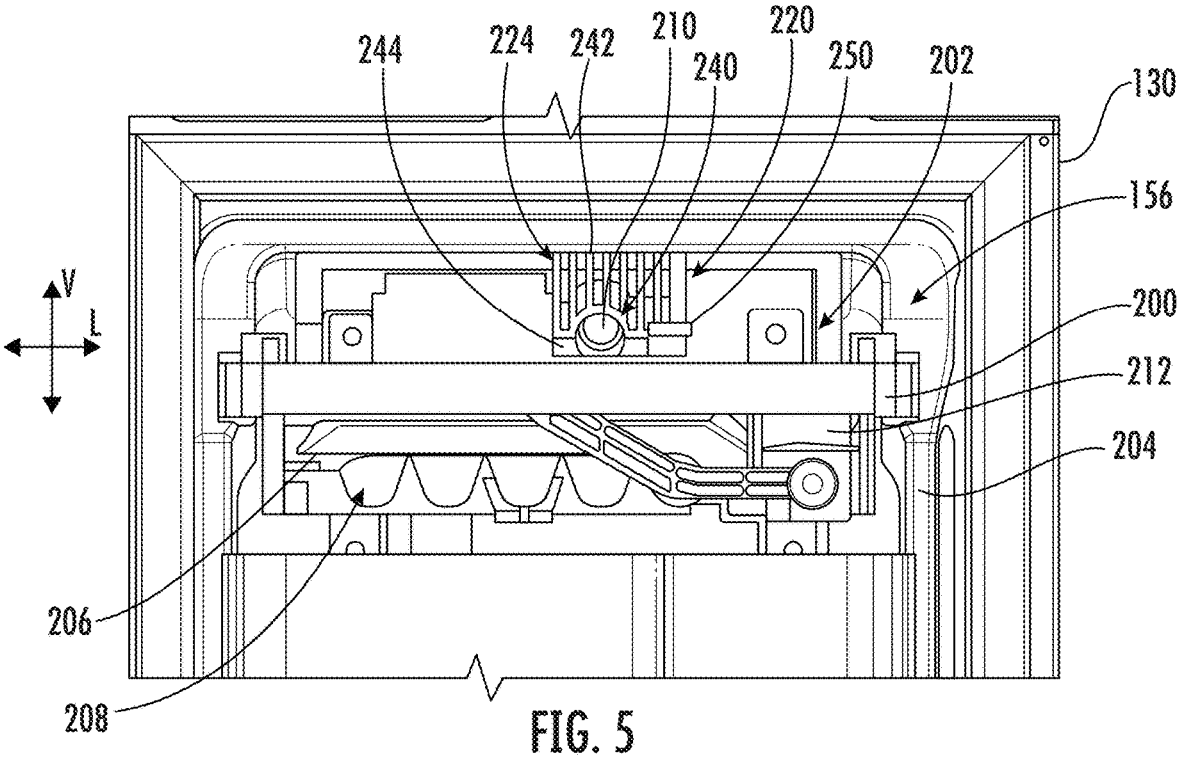
FIG. 5 provides a front view of the example ice making assembly of FIG. 3 according to an example embodiment of the present subject matter.
Figure 6:
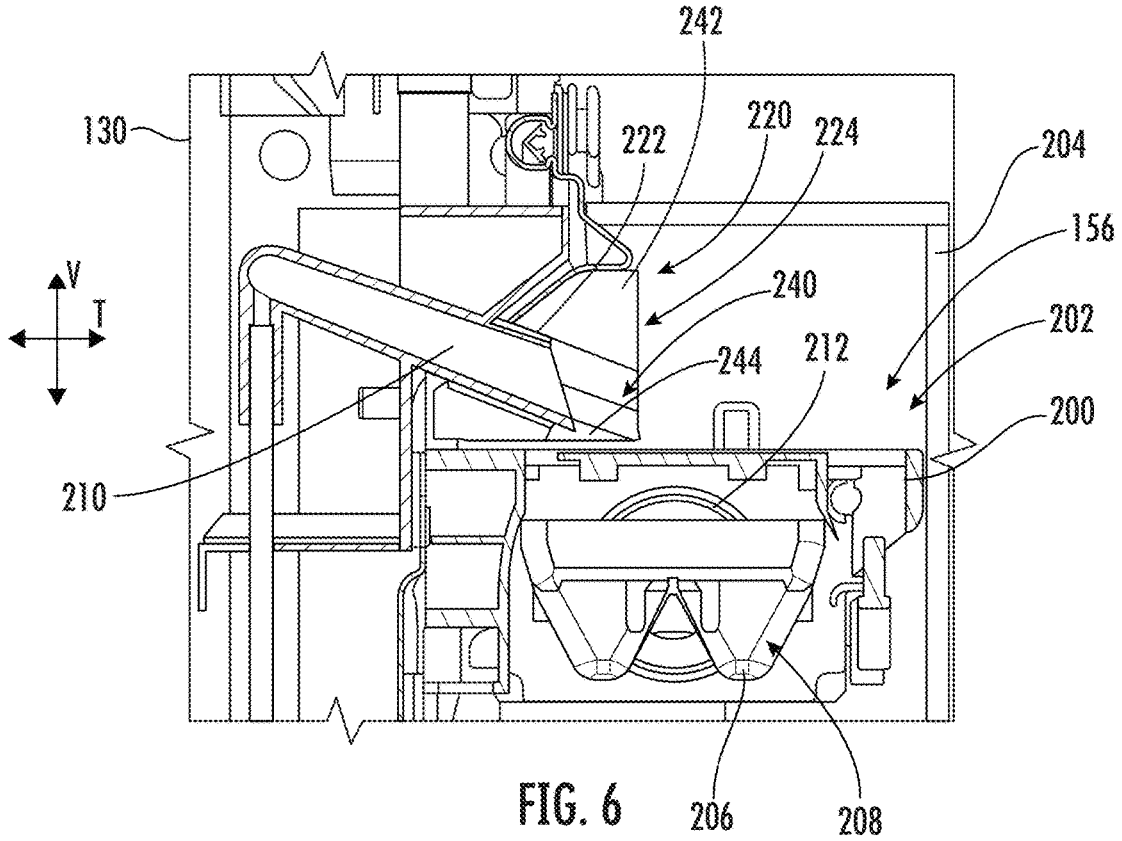
FIG. 6 provides a side, cross-sectional view of the example ice making assembly of FIG. 3 according to an example embodiment of the present subject matter.

FIG. 2 provides a front view of refrigerator appliance 100 shown with refrigerator door 128 and freezer door 130 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items) and may assist with organizing such food items. As illustrated, bins 134 may be mounted on refrigerator door 128 and freezer door 130 or may slide into a receiving space in fresh food chamber 122 or freezer chamber 124. It should be appreciated that the illustrated storage components are used only for the purpose of explanation and that other storage components may be used and may have different sizes, shapes, and configurations.

Referring now generally to FIG. 1, a dispensing assembly 140 will be described according to exemplary embodiments of the present subject matter. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on freezer door 130. In this regard, dispenser recess 142 is defined on a front side 112 of refrigerator appliance 100 such that a user may operate dispensing assembly 140 without opening freezer door 130. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142.

Referring again to FIG. 2, inside refrigerator appliance 100, freezer door 130 may include an ice dispensing system 150 that generally includes one or more icemakers and ice storage bins 152 that are configured to form ice. In this regard, for example, ice dispensing system 150 may define an ice making chamber 154 for housing ice making assemblies, storage mechanisms, and dispensing mechanisms. According to the illustrated embodiment, ice dispensing system 150 may include dispensing assembly 140 and may have a main icemaker 156. In addition, ice dispensing system 150 may include an icemaker for forming "craft ice" that is commonly large, clear cubes or spheres of ice for alcoholic or non-alcoholic drinks. For example, a user may access this craft ice by opening freezer door 130 and accessing storage bin 152 directly.

A control panel 160 is provided for controlling the mode of operation. For example, control panel 160 includes one or more selector inputs 162, such as knobs, buttons, touch-screen interfaces, etc., such as a water dispensing button and an ice-dispensing button, for selecting a desired mode of operation such as crushed or non-crushed ice. In addition, inputs 162 may be used to specify a fill volume or method of operating dispensing assembly 140. In this regard, inputs 162 may be in communication with a processing device or controller 164. Signals generated in controller 164 operate refrigerator appliance 100 and dispensing assembly 140 in response to selector inputs 162. Additionally, a display 166, such as an indicator light or a screen, may be provided on control panel 160. Display 166 may be in communication with controller 164 and may display information in response to signals from controller 164.

As used herein, "processing device" or "controller" may refer to one or more microprocessors or semiconductor devices and is not restricted necessarily to a single element. The processing device can be programmed to operate refrigerator appliance 100 and dispensing assembly 140. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations.

Referring again briefly to FIG. 1, according to an exemplary embodiment, cabinet 102 also defines a mechanical compartment 170 at or near the bottom 106 of the cabinet 102 for receipt of a hermetically sealed cooling system 172. In general, sealed cooling system 172 is configured for transporting heat from the inside of refrigerator appliance 100 to the outside (e.g., by executing a vapor-compression cycle or another suitable refrigeration cycle). As is generally understood by those of skill in the art, the hermetically sealed system 172 contains a working fluid, e.g., refrigerant, which flows between various heat exchangers of the sealed system 172 where the working fluid changes phases while transferring thermal energy.

In this regard, as understood by one having ordinary skill in the art, sealed system 172 may include a compressor, a condenser, an expansion device, and one or more evaporators connected in series by a fluid conduit that is charged with a refrigerant. Within sealed system 172, refrigerant flows into the compressor, which operates to increase the pressure of the refrigerant. This compression of the refrigerant raises its temperature, which is lowered by passing the refrigerant through the condenser. Within the condenser, heat exchange with ambient air takes place so as to cool the refrigerant. A condenser fan may be used to pull air across the condenser, so as to provide forced convection for a more rapid and efficient heat exchange between the refrigerant within the condenser and the ambient air. Thus, as will be understood by those skilled in the art, increasing air flow across the condenser can, e.g., increase the efficiency of the condenser by improving cooling of the refrigerant contained therein.

An expansion device (e.g., an electronic expansion valve, capillary tube, or other restriction device) receives refrigerant from the condenser. From the expansion device, the refrigerant enters the evaporator. Upon exiting the expansion device and entering the evaporator, the refrigerant drops in pressure. Due to the pressure drop and/or phase change of the refrigerant, the evaporator is relatively cool. An evaporator fan is typically provided at each the evaporator, e.g., to force air across and around the at least one evaporator to transfer thermal energy from the air to the evaporator (and more particularly, to the working fluid or refrigerant therein).

In this manner, a flow of cooling air exits the evaporator and may be distributed to one or more of the chilled chambers 122 and/or 124. Specifically, one or more ducts may extend between the mechanical compartment 170 and the chilled chambers 122 and/or 124 to provide fluid communication therebetween, e.g., to provide the chilled air from the hermetically sealed cooling system 172, e.g., from an evaporator thereof, to one or more of the chilled chambers 122 and/or 124.

The sealed system 172 described herein is provided by way of example only. Thus, it is within the scope of the present subject matter for other configurations of the refrigeration system to be used as well. For example, according to alternative embodiments, sealed system 172 may include additional components, e.g., at least one additional evaporator, compressor, expansion device, and/or condenser. For example, refrigerator appliance 100 may have two or more split evaporators, e.g., one dedicated primarily to cooling fresh food chamber 122 and one dedicated primarily to cooling freezer chamber 124. In addition, alternative plumbing configurations, valves, and flow regulators may be used to route refrigerant throughout sealed system 172.

Referring now specifically to FIGS. 3 through 7, icemaker 156 will be described in more detail according to example embodiments of the present subject matter. According to the illustrated embodiment, icemaker 156 is mounted to freezer door 130 of refrigerator appliance 100. As explained briefly above, formation of ice with improved clarity, e.g., craft ice, often requires freezing temperatures that are elevated relative to the chilled chamber where icemaker 156 is located. For example, a common temperature for freezer chamber 124 may be around 0° F., while ice with improved clarity is typically formed at temperatures around 15° F. Accordingly, aspects of the present subject matter are directed to features of icemaker 156 that may maintain a suitable climate for forming clear ice without additional heaters, costs, and complexity. Although an exemplary construction is described herein, it should be appreciated that variations and modifications may be made while remaining within the scope of the present subject matter.

As shown, icemaker 156 may generally include an icemaker frame 200 that is mounted to freezer door 130, e.g., within ice dispensing system 150. In general, icemaker frame 200 is a substantially rigid structure that is fixed in position to freezer door 130 and which generally defines an ice making chamber 202 (e.g., the same or similar as ice making chamber 154) where ice is formed. According to the illustrated embodiment, icemaker 156 may further include an insulating layer 204 that is positioned at least partially around or within icemaker frame 200. In this regard, insulating layer 204 may include one or more insulating panels, foam, or other structure that reduces heat transfer between ice making chamber 202 and freezer chamber 124, thereby facilitating some independent temperature regulation within ice making chamber 202.

Icemaker frame 200 may further include one or more structures that are coupled for supporting various components of icemaker 156 as described herein. For example, icemaker 156 may further include an ice tray 206 that is rotatably mounted to icemaker frame 200 and which defines a plurality of mold cavities 208 for receiving water that is formed into ice during the ice production process. In this regard, refrigerator appliance 100 may include a water fill tube 210 that may be used to selectively dispense water into mold cavities 208 to facilitate ice formation. For example, water may be supplied to fill tube 210 from a water supply system of dispensing assembly 140.

According to the illustrated embodiment, ice tray 206 is a twistable ice tray that is distorted in order to facilitate the release of ice. In this regard, ice tray 206 may be rotatable between a first position or the "home position" or "ice making position" (e.g., as shown for example in FIGS. 3 through 6) where water fill tube 210 may be used to fill mold cavities 208 with liquid water. During the harvest process, ice tray 206 may be rotated within icemaker frame 200 by a drive motor 212. Icemaker frame 200 may further include a structural stop (not shown) that engages ice tray 206 to prevent localized rotation at one or more locations, thus resulting in the twisting of ice tray 206. This position may be referred to herein generally as the "harvest position." Accordingly, as drive motor 212 continues to rotate ice tray 206, structural stop causes ice tray 206 to twist and deform the mold cavities 208 in a manner that releases the ice cubes. It should be appreciated that the present subject matter is equally applicable to ice making assemblies that utilize other ejection mechanisms, e.g., such as sweep arms, ejection plungers, etc.

In general, the temperature within ice making chamber 202 is largely regulated by sealed system 172 of refrigerator appliance 100. In this regard, cool air generated by sealed system 172 may be passed into freezer chamber 124 where at least a portion of the cool air is directed into ice making chamber 202, e.g., through one or more apertures, louvers, fan systems, etc. Accordingly, absent additional means for regulating the temperature of ice making chamber 202, the temperature within ice making chamber 202 may be substantially the same as freezer chamber 124. As noted above, this temperature may not be suitable for forming clear craft ice.

Accordingly, according to an example embodiment of the present subject matter, icemaker 156 may include a heating assembly 220 that is in operative communication with controller 164 for selectively regulating a temperature within ice making chamber 202. In this regard, as illustrated for example in FIGS. 3 through 7, heating assembly 220 includes a heating element 222 and a heat sink 224 that are thermally coupled to fill tube 210. In this manner, controller 164 may selectively energize heating element 222 to heat the water flowing through fill tube 210 and/or the air within ice making chamber 202.

In general, heating element 222 may be any suitable number, type, and configuration of heaters thermally coupled to fill tube 210 and/or ice making chamber 202 for adding thermal energy thereto. For example, heating element 222 may be a thin resistive heater wrapped around fill tube 210. For example, heating element 222 may include a silicone heating wire 230 positioned within a conductive foil 232. For example, conductive foil 232 may be flexible aluminum foil with adhesive applied to one or more sides to sandwich silicone heating wire 230 therebetween. The result is a thin, flexible sheet that may be energized by controller 164 to generate heat.

Moreover, heating element 222 may be positioned at any suitable location for introducing heat into fill tube 210, water being dispensed from fill tube 210, or ice making chamber 202 directly. For example, as illustrated, heating element 222 may be positioned at a distal end of fill tube 210. For example, heating element 222 may be wrapped around fill tube 210 to prevent water from freezing and clogging fill tube 210. In addition, as described in more detail below, heating assembly 220 may include features for harnessing heat from heating element 222 and using it to raise the temperature of ice making chamber 202 to a suitable temperature for producing clear ice.

Figure 7:
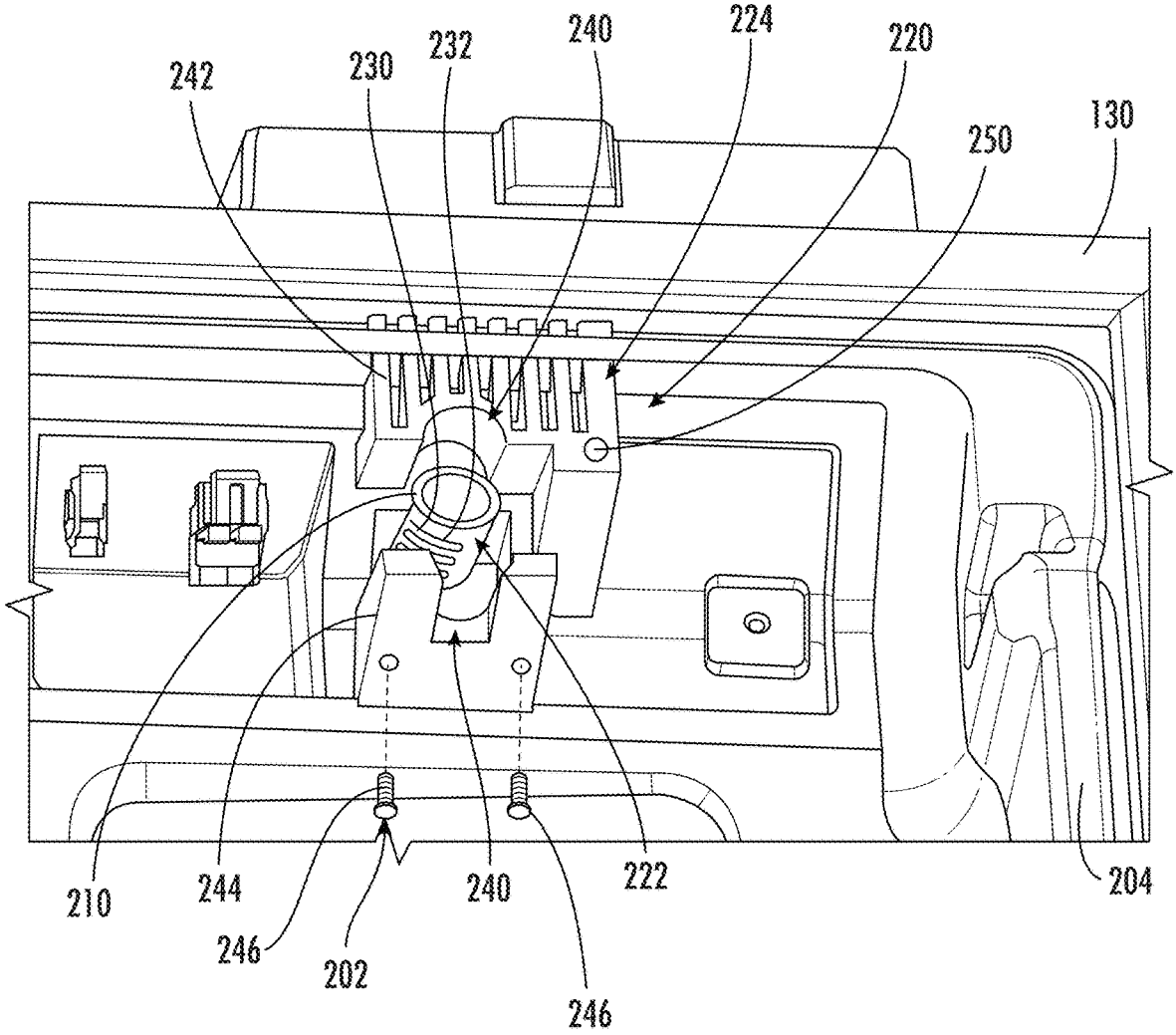
FIG. 7 provides an exploded view of a heating assembly for use with the example ice making assembly of FIG. 3 according to an example embodiment of the present subject matter.

In this regard, heat sink 224 may be thermally coupled to heating element 222, e.g., to provide improved surface area for convective heat transfer with the air in ice making chamber 202. In this regard, for example, fill tube 210 may pass through heat sink 224 or may otherwise be in thermal contact with heat sink 224. In this regard, as illustrated, heat sink 224 may define an aperture or grooves 240 through which fill tube 210 may be seated when heat sink 224 is installed. More specifically, as illustrated in FIG. 7, heat sink 224 may include a first portion 242 and a second portion 244 that are clamped onto fill tube 210 over heating element 222, e.g., via one or more mechanical fasteners 246. In addition, heating element 222 may be positioned between heat sink 224 and fill tube 210, such that tightening mechanical fasteners 246 ensures good thermal contact between fill tube 210, heating element 222, and heat sink 224. In this manner, heating element 222 may be used to heat both fill tube 210 and ice making chamber 202, resulting in fewer components, costs, etc.

It should be appreciated that heat sink 224 may generally be formed from any suitably rigid and thermally conductive material. For example, according to the example embodiment, heat sink 224 is formed from a block of aluminum, though other suitably conductive materials may be used. In addition, heat sink 224 may include additional features for improving heat exchange with air in ice making chamber 202, such as heat exchange fins. In addition, although heating assembly 220 is described herein as a passive system relying on natural convention, it should be appreciated that heating assembly 220 may further include one or more fans, louvers, or other flow regulating devices to facilitate circulation of relatively warm air. Other heat exchanger constructions are possible and within the scope of the present subject matter.

According to example embodiments, one or more temperature sensors may be used to provide useful feedback regarding the operation of heating assembly 220 and the ice making conditions of ice making chamber 202. For example, heating assembly 220 may include a heater temperature sensor 250 for measuring a heater temperature of heating assembly 220. This measured temperature may be used to ensure a safe operating temperature of heating element 222 (e.g., to prevent melting fill tube 210) and may also be used to deduce the amount of thermal energy being added to ice making chamber 202. According to the illustrated embodiment, heater temperature sensor 250 may be embedded in heat sink 224, though other methods of attachment and thermal engagement are possible and within the scope of the present subject matter. In addition, icemaker 156 may include a chamber temperature sensor 252 positioned within ice making chamber 202 for measuring a chamber temperature of ice making chamber 202. In addition, heating assembly 220 may further include a thermal fuse (not shown) to shut off heating assembly 220 if it gets too warm.

As used herein, "temperature sensor" or the equivalent is intended to refer to any suitable type of temperature measuring system or device positioned at any suitable location for measuring the desired temperature. Thus, for example, temperature sensors 250, 252 may each be any suitable type of temperature sensor, such as a thermistor, a thermocouple, a resistance temperature detector, a semiconductor-based integrated circuit temperature sensor, etc. In addition, temperature sensors 250, 252 may be positioned at any suitable location and may output a signal, such as a voltage, to a controller that is proportional to and/or indicative of the temperature being measured. Although exemplary positioning of temperature sensors is described herein, it should be appreciated that refrigerator appliance 100 may include any other suitable number, type, and position of temperature, humidity, and/or other sensors according to alternative embodiments.

The measured temperature of heating assembly 220 and/or the measured chamber temperature may be used as feedback in regulating the operation of heating assembly 220 to achieve a target ice formation temperature. In this regard, for example, controller 164 may be in operative communication with one or both of heater temperature sensor 250 and chamber temperature sensor 252. Controller 164 may be configured to receive a request to form clear ice. For example, a user may use control panel 160 to request that the ice formation process be switched from a standard ice making process to the clear or "craft" ice making process. Notably, when clear ice is requested, controller 164 may energize heating assembly 220 while dispensing water through fill tube (e.g., using a water supply valve of dispensing assembly 140).

Heating assembly 220 may remain energized as water is being dispensed to fill ice tray 206 and afterwards to selectively heat ice making chamber 202 to a desired temperature. In this regard, controller 164 may measure a temperature using at least one of heater temperature sensor 250 or chamber temperature sensor 252. In addition, controller 164 may control the operation of heating assembly 220 (e.g., by regulating the applied voltage) to heat chamber based at least in part on the measured temperature(s). In addition, heating assembly 220 may be used for the entirely different purpose of periodically clearing clogs in fill tube 210 or other desirable purposes.

As explained herein, aspects of the present subject matter are generally directed to an ice maker with a heating system and control algorithm to maintain slightly higher enclosure temperature by using one heater as both fill tube heater and enclosure heater. The fill tube heater may be used to heat both the tube and air around the ice maker in an insulated enclosure. The heater may be mounted on an aluminum heatsink with extended surfaces. The heatsink with the heater may then be clamped to the fill tube. The extended surface allows effective heating of the enclosure while minimizing the heater and tube temperatures.

The heatsink can also have a hole to fit a temperature sensor such as a thermistor. The thermistor temperature could be used to drive an algorithm to determine when to power on the heater. The heater may also comprise a thermal fuse to shut it off when it turns too hot. Additionally, a second temperature sensor could be mounted inside the enclosure to determine the air temperature away from the heater assembly and the software algorithm may be utilized to control the heater, considering the temperature of one or both sensors to determine when to power the heater.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A refrigerator appliance defining a vertical direction, a lateral direction, and a transverse direction, comprising:
- a cabinet defining a chilled chamber;
- a door rotatably mounted to the cabinet and rotatable between a closed position enclosing the chilled chamber and an open position providing access to the chilled chamber; and
- an ice making assembly comprising:
  - an icemaker frame assembly defining an ice making chamber;
  - an ice tray mounted to the icemaker frame assembly and defining a plurality of mold cavities for receiving water that is formed into ice;
  - a fill tube for selectively supplying the water into the ice tray; and
  - a heating assembly comprising a heating element and a heat sink that are thermally coupled to the fill tube, wherein the heating element is selectively energized to heat the water flowing through the fill tube and the ice making chamber, wherein the heat sink comprises a first portion and a second portion that are clamped onto the fill tube over the heating element.

2. The refrigerator appliance of claim 1, wherein the fill tube passes through the heat sink.

3. The refrigerator appliance of claim 1, wherein the first portion and the second portion define grooves for engaging the fill tube when joined.

4. The refrigerator appliance of claim 1, wherein the heat sink is formed from aluminum.

5. The refrigerator appliance of claim 1, wherein the heating element is a resistive heater wrapped around the fill tube.

6. The refrigerator appliance of claim 5, wherein the resistive heater comprises a silicone wire heating element positioned within a conductive foil.

7. The refrigerator appliance of claim 1, wherein the heating element positioned at a distal end of the fill tube.

8. The refrigerator appliance of claim 1, further comprising:
- a heater temperature sensor for measuring a heater temperature of the heating assembly.

9. The refrigerator appliance of claim 8, wherein the heater temperature sensor is embedded in the heat sink.

10. The refrigerator appliance of claim 1, further comprising:
- a chamber temperature sensor for measuring a chamber temperature of the ice making chamber.

11. The refrigerator appliance of claim 1, further comprising at least one of a heater temperature sensor or a chamber temperature sensor, and a controller in operative communication with the heating assembly, the controller being configured to:

receive a request to form clear ice;

energize the heating assembly while dispensing water through the fill tube;

measure a temperature using at least one of the heater temperature sensor or the chamber temperature sensor; and adjust operation of the heating assembly based at least in part on the temperature.

12. The refrigerator appliance of claim 11, wherein adjusting operation of the heating assembly comprises operating the heating assembly to maintain the ice making chamber at a temperature that is higher than a chilled chamber temperature of the chilled chamber.

13. The refrigerator appliance of claim 1, wherein the heating assembly further comprises:

a thermal fuse operably coupled to the heating element.

14. The refrigerator appliance of claim 1, wherein the ice making assembly further comprises:

an insulating layer positioned around or within the icemaker frame assembly.

15. The refrigerator appliance of claim 1, wherein the ice making assembly is mounted to the door of the refrigerator appliance.

16. The refrigerator appliance of claim 1, wherein the refrigerator appliance is a side-by-side refrigerator appliance and the chilled chamber is a freezer chamber.

17. An ice making assembly of a refrigerator appliance, the ice making assembly comprising:

an icemaker frame assembly defining an ice making chamber;

an ice tray positioned in the ice making chamber and defining a plurality of mold cavities for receiving water that is formed into ice;

a fill tube for selectively supplying the water into the ice tray; and a heating assembly comprising a heating element and a heat sink that are thermally coupled to the fill tube, wherein the heating element is selectively energized to heat the water flowing through the fill tube and the ice making chamber, wherein the heat sink comprises a first portion and a second portion that are clamped onto the fill tube over the heating element.

18. The ice making assembly of claim 17, wherein the heating element is a resistive heater wrapped around the fill tube and is positioned at a distal end of the fill tube.

* * * * *